United States Patent [19]

Theurer et al.

[11] 4,258,626

[45] Mar. 31, 1981

[54] MOBILE TIE LAYING APPARATUS

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 37,100

[22] Filed: May 8, 1979

[30] Foreign Application Priority Data

Jun. 14, 1978 [AT] Austria ..... 4349/78

[51] Int. Cl.[3] ..... E01B 29/10

[52] U.S. Cl. ..... 104/6

[58] Field of Search ..... 104/6, 8

[56] References Cited

U.S. PATENT DOCUMENTS 4,080,903 3/1978 Cicin-Sain ..... 104/6

4,184,431 1/1980 Goel ..... 104/6

*Primary Examiner*—Richard A. Bertsch

*Attorney, Agent, or Firm*—Kurt Kelman

[57] ABSTRACT

A mobile track laying apparatus comprises an elevator on a vehicle movement along a right-of-way for lowering a succession of ties, a roller and gliding conveyor receiving the lowered ties and laying the ties on the ballast as the vehicle moves along the right-of-way in an operating direction, and a guide wheel power-driven to rotate about a horizontal axis extending transversely to the right-of-way, the guide wheel having a plurality of radially extending abutment and entrainment elements arranged to interdigitate between the successively lowered ties in an end region of the conveyors adjacent the ballast.

14 Claims, 3 Drawing Figures

MOBILE TIE LAYING APPARATUS

Figure 1:
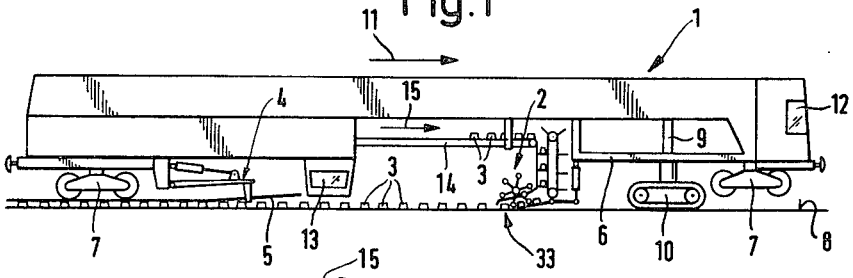

The present invention relates to a mobile apparatus for laying a succession of spaced ties on track-supporting ballast along a right-of-way. Known apparatus of this type comprises a vehicle movable along the right-of-way, means arranged to receive the ties to be laid and to lower the received ties, means arranged to receive the lowered ties and to lay the ties on the ballast, the tie laying means including a roller conveyor, a gliding conveyor, and a device for spacedly laying the succession of the conveyed ties on the ballast as the vehicle moves along the right-of-way in an operating direction.

Such an apparatus has been disclosed, for example, in Austrian Pat. No. 343,163, published Sept. 15, 1977. In this apparatus, a pair of tie positioning mechanisms is associated with the gliding conveyors for cooperation with the tie ends, each mechanism comprising four hydraulically-operated tie engaging elements requiring relatively complex controls. The roller and gliding conveyors are relatively long, thus increasing the over-all length of the equipment, and the successive ties are abuttingly conveyed along the entire length of the roller and gliding conveyors, which may cause damage to the tie edges, particularly in case of concrete ties and especially along the gliding path of the conveyed ties where they are conveyed substantially by pressure of succeeding ties on the preceding ties gliding down the gliding conveyor. Furthermore, the operation of the tie engaging elements causes the ties to be tilted about their longitudinal axis when they are positioned on the ballast, which may cause the laid ties to deviate from their desired geometric position. The tie engaging elements themselves are subject to considerable wear.

British Pat. No. 1,363,704, published Aug. 14, 1974, discloses a railway track laying machine with means for longitudinally and laterally aligning ties remaining on the ballast before the new track rails are laid. This tie aligning means comprises a pair of wheels associated with the tie ends and having six peripheral recesses for receiving successive ties. The wheels are supported on downwardly inclined shafts lying in a plane perpendicular to the axis of the main vehicle and are driven in dependence on the forward speed of the vehicle. The aligning means of this apparatus cannot be used for laying ties.

Swiss Pat. No. 594,105, published Dec. 30, 1977, discloses a track renewal train for replacing old ties and rails by new ties and rails. This train comprises a track-laying vehicle which carries an elongated conveyor transporting a succession of spaced ties to a guide wheel with spokes which move the ties to a steeply inclined gliding conveyor whence they are conveyed by gravity to a stop which controls the positioning of the successive ties on the ballast. Since the guide wheel reverses the ties, they must be stored upside down on the conveyor, which is disadvantageous since different tie types have different upper faces and this requires different conveyor structures for support thereof. Furthermore, the gravity feed and impact of the gravity-fed ties against the positioning stop again involves the danger of damage to the ties.

The track laying apparatus disclosed in French patent publication No. 2,299,459, dated Aug. 27, 1976, comprises a chain elevator for lowering successive ties onto the ballast. Since the ties tend to glide and tilt on the chain entrainment elements when they are positioned on the ballast, they tend to be misaligned thereon.

Austrian Pat. No. 340,460, published Apr. 15, 1977, discloses a much improved apparatus for laying ties exactly positioned on the ballast. This apparatus comprises a two-part endless conveyor for a succession of ties, the ties being conveyed to the ballast suspended from the lower course of a downwardly inclined conveyor part for deposition on the ballast without gliding or tilting.

It is the primary object of this invention to provide a mobile apparatus of the first-described type which assures a substantially continuous tie laying operation while safeguarding the ties as well as the structural components of the apparatus as much as possible against damage while, at the same time, being exceedingly compact, particularly in the longitudinal direction of the tie-laying vehicle.

This and other objects are accomplished according to the invention with a tie laying device which comprises a power-driven guide wheel rotatable about a horizontal axis extending transversely of the right-of-way and a plurality of abutment and entrainment elements mounted on the wheel and arranged to interdigitate between successive ones of the conveyed ties in an end region of the tie laying means adjacent the ballast.

This construction of the tie laying device assures a uniform conveyance of the successive ties in a predetermined spacing from each other to the ballast where they are positioned with great accuracy. Furthermore, since the interdigitating abutment and entrainment elements keep the successive ties apart, any danger of ties being damaged by abutting ties is eliminated. In addition, the device has a minimum of moving parts and these parts are not subjected to impact and frictional forces so that they are relatively wear-resistant and assure proper operation even after extended use.

Figure 2:
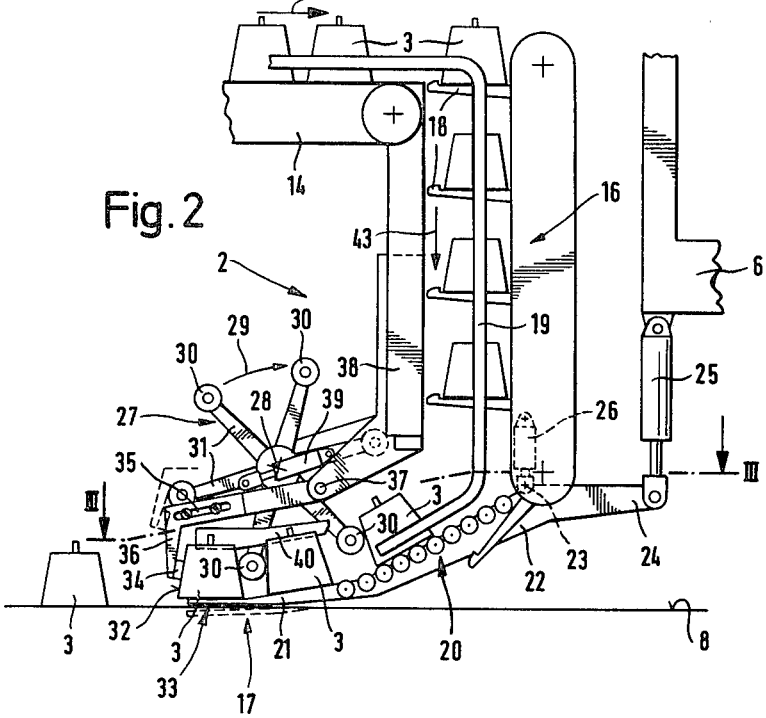
Figure 3:
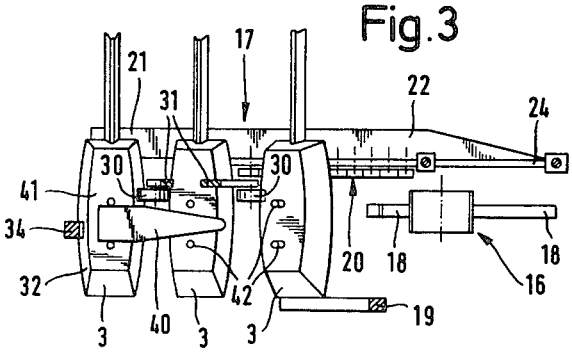

The above and other objects, advantages and features of the present invention will become more apparent from the following detailed description of a now preferred embodiment thereof, taken in conjunction with the accompanying, generally schematic drawing wherein FIG. 1 is a side elevational view of a mobile apparatus incorporating this invention;

FIG. 2 is an enlarged side elevational view of the tie laying means and device of the invention; and FIG. 3 is a partial top view taken along line III—III of FIG. 2.

Referring now to the drawing and first to FIG. 1, the mobile apparatus for laying a succession of spaced ties 3 on ballast 8 along a right-of-way comprises vehicle 1 movable along the right-of-way. As is known and has no bearing on the present invention, the vehicle comprises frame 6 provided with two-axled undercarriages 7, 7 capable of running on track rails, one of undercarriages 7 being retractable, as shown, so that it may be replaced be retractably mounted track-laying bogie 10 which supports the front end of the vehicle frame on ballast 8 in the track replacement zone while vehicle 1 moves along the right-of-way in the operating direction indicated by arrow 11. Drive 9 enables bogie 10 to be lowered and raised into and out of contact with the ballast. As is also known, frame 6 carries rail guide means 4 for receiving and guiding new rails 5 to be laid on the newly laid ties 3. A first operator's cab 12 with a suitable control panel is mounted at a front end of vehicle frame 6 while another operator's cab 13 is mounted on the vehicle frame between rail guide means 4 and tie laying means 2 to supervise the tie and rail laying operations.

Endless tie conveyor 14 is mounted centrally on vehicle 1 and extends longitudinally to transport a succession of new ties 3 in the direction of arrow 15 to tie laying means 2, the ties being positioned on the conveyor transversely and being received in this position on successive ones of carrier arms 18 of track lowering means 16 illustrated as an endless elevator chain suitably driven to move the carrier arms vertically.

Means 17 is arranged on vehicle 1 to receive lowered ties 3 from track lowering means 16 and extends obliquely towards ballast 8 in a direction opposite to that of operating direction 17 of vehicle 1 to lay the ties on the ballast. The new ties are laterally aligned and centered on endless conveyors 14 and 16 by guide bars 19 extending alongside the respective ends of ties 3, these guide bars extending further along a portion of tie laying means 17. The tie laying means includes roller conveyor 20 descending towards ballast 8 at an acute angle thereto and abutting gliding conveyor 21 ending in a horizontal end portion adjacent the ballast at each side of vehicle frame 6 for support of the respective ends of ties 3 during their conveyance to the ballast on the conveyors. In the illustrated embodiment, two-armed carrier lever 22 is pivotally mounted on horizontal axle 23 extending transversely of the right-of-way in the lower portion of tie lowering means 16 and carries conveyors 20 and 21 whose vertical position in relation to ballast 8 is adjustable by pivoting of the carrier lever and by vertically adjusting the position of the carrier lever. One end of carrier lever arm 24 is linked to one end of hydraulic drive 25 whose other end is linked to vehicle frame 6 for pivoting the carrier lever. Hydraulic drive 26 is linked to pivoting axle 23 of carrier lever 22 to enable the carrier lever to be lowered and raised.

Each tie laying means 17 at the respective sides of vehicle frame 6 comprises a device for spacedly laying the succession of conveyed ties 3 on ballast 8 as vehicle 1 moves along the right-of-way in operating direction 11 and this device comprises power-driven guide wheel 27 rotatable about horizontal axis 28 extending transversely of the right-of-way in the direction of arrow 29, the wheel being rotated by a suitable drive, such as a hydraulic motor. A plurality of abutment and entrainment elements are mounted on the wheel and are arranged to interdigitate between successive ones of conveyed ties 3 in an end region of tie laying means 17 adjacent ballast 8, this end region terminating at 33 where the successive ties are laid on the ballast as vehicle 1 moves forwardly. In the illustrated embodiment, the abutment and entrainment elements consist of circumferentially equidistantly spaced radially extending arms 31 extending from guide wheel 27 and carrying idling rollers 30 at outer ends thereof. This structure reduces frictional forces between successive ties 3 and the abutment and entrainment elements to a minimum, thus similarly minimizing wear on the elements as well as leading faces 32 of ties 3 which are contacted by idling rollers 30. Furthermore, this structure requires a minimal drive force.

Axle 28 of guide wheel 27 is low enough in relation to the length of radial arms 31 to assure that the paths of movement of abutment and entrainment elements 30, 31 and of ties 3 conveyed by conveyors 20 and 21 overlap at least over the range of two successive ties, this overlapping range extending over the entire length of gliding conveyor 21 and an abutting portion of roller conveyor 20 corresponding to at least one tie width in the illustrated embodiment. In view of this geometric relationship, the abutment and entrainment elements 30, 31 always enter into the space between two successive ties 3. As clearly shown in FIG. 2, this assures not only that an abutment and entrainment element will interdigitate between two successive ties closest to tie laying position 33 but a successive abutment and entrainment element will hold the next succeeding tie, which is still on the roller conveyor, at a desired distance, thus counteracting the force of gravity exerted upon this next succeeding tie and preventing it from coming into abutting relationship with the preceding tie. The preferred and illustrated geometric relationship assures full operating safety under all operating conditions. For instance, if the force of gravity alone should not suffice to transmit a tie from the roller to the gliding conveyor, due to some out-dimension of a tie or dirt accumulation, for example, the revolving abutment and entrainment elements 30, 31 will engage the trailing face of the tie and entrain it onto the gliding conveyor. Thus, no jamming of ties can occur at this transition point.

Guide stop 34 is associated with each guide wheel 27 and is engageable with the leading faces 32 of successive ties 3 adjacent terminus 33. In the illustrated embodiment, the guide stop is carried by lever 36 and a horizontal axis 37 extending transversely of the right-of-way supports an end of lever 36 remote from guide stop 34 for pivoting. Drive 39 has one end linked to lever 36 and another end linked to machine frame part 38 for pivoting lever 36 about axis 37. The illustrated lever is of adjustable length, its two parts being interconnected by screws passing through elongated slot 35 in one of the lever parts.

Tie aligning member 40 is associated with each guide wheel 27 and is arranged above the conveyed ties to cooperate with the successively conveyed ties for laterally aligning or centering the ties, the aligning member tapering in the direction of roller conveyor 20, i.e. opposite the conveying direction of the ties. The tie aligning member engages corresponding abutments on the advancing ties for aligning the ties as they reach position 33 where they are laid on the ballast. In the illustrated embodiment, these abutments are constituted by rail fastening bolts 42 at ends 41 of ties 3. This constitutes a very simple and space-saving means for the accurate alignment of the laid ties.

The entire tie-laying arrangement takes up very little space and is very compact since guide wheels 27 are mounted in the otherwise wasted space defined by vertical tie conveyor 16 and tie conveyors 20 and 21 which extend rearwardly thereof in the operating direction of vehicle 1. This considerably shortens the tie laying equipment.

The operation of the apparatus will partly be obvious from the above description of its structure and will be explained in detail hereinafter.

Vehicle 1 advances continuously at a substantially constant speed in the direction of arrow 11, the forward end of the vehicle being supported on ballast 8 by track-laying bogie 10 while the rear vehicle end is supported on the newly laid track by track-bound swivel truck 7. Elongated tie conveyor 14 receives a continuous supply of new tie 3 positioned transversely of the right-of-way from tie supply cars (not shown) forming part of the track renewal train and delivers a succession of the ties to successive carrier arms 18 of elevator 16 which lowers the ties in the direction of arrow 43. As each arm 18 reaches the lower end of the endless chain conveyor constituting elevator 16 and the endless chain moves its lower pulley, the carrier arm assumes an increasingly oblique position (see FIG. 2), one of which corresponds to the angle of roller conveyor 20 so that each tie is smoothly transferred from carrier arm 18 to the roller conveyor where gravity causes the tie to be conveyed down the roller conveyor towards gliding conveyor 21. Guide wheel 27 is rotated at a predetermined rotary speed coordinated with the forward speed of vehicle 1 so that a respect roller 30 on radial arms 31 comes into abutting contact with leading face 32 of each tie as it comes down roller conveyor 20. At this point, the tie no longer moves under the force of gravity but is entrained by rotating guide wheel 27 to and along gliding conveyor 21, being spaced from the preceding tie by the interdigitating element 30, 31. At the same time, leading face 32 of the foremost tie at the terminal position 33 is contacted by guide stop 34 and aligning member 40 is engaged between rail fastening bolts 41 of the foremost tie in accurately aligned position for being laid on ballast 8. Drive 39 is now actuated to pivot lever 36 with stop 34 out of the path of the ties and drive 25 is actuated to lower conveyor carrier 22 into the recessed central trench in ballast 8, two longitudinally extending raised ballast strips extending below the rails for support of the ties underneath the rails. This causes each successive tie to be laid as the vehicle moves forwardly. The lowered tie laying position of conveyor carrier 22 is shown in broken lines in FIG. 2. Each guide wheel 27 continues to rotate, it conveys successive ties 3 suitably spaced from each other to tie laying site 33, stop 34 being pivoted back into position as each tie is laid.

What is claimed is:

1. A mobile apparatus for laying a succession of spaced ties on track-supporting ballast along a right-of-way, which comprises a vehicle movable along the right-of-way, means arranged on the vehicle to receive the ties to be laid and to lower the received ties, means arranged on the vehicle to receive the lowered ties and to lay the ties on the ballast, the tie laying means including a roller conveyor, a gliding conveyor, and a device for spacedly laying the succession of the conveyed ties on the ballast as the vehicle moves along the right-of-way in an operating direction, wherein the device comprises a power-driven guide wheel rotatable about a horizontal axis extending transversely of the right-of-way and a plurality of abutment and entrainment elements mounted on the wheel and arranged to interdigitate between successive ones of the conveyed ties in an end region of the tie laying means adjacent the ballast.

2. The mobile apparatus of claim 1, wherein the paths of movement of the abutment and entrainment elements and of the ties conveyed by the tie laying means overlap at least over the range of two successive ties.

3. The mobile apparatus of claim 2, wherein the overlapping range of the movement paths extend over the entire length of the gliding conveyor and a portion of the roller conveyor corresponding to at least one tie width.

4. A mobile apparatus for laying a succession of spaced ties on track-supporting ballast along a right-of-way, which comprises a vehicle movable along the right-of-way, means arranged on the vehicle to receive the ties to be laid and to lower the received ties, means arranged on the vehicle to receive the lowered ties and to lay the ties on the ballast, the tie laying means including a roller conveyor, a gliding conveyor, and a device for spacedly laying the succession of the conveyed ties on the ballast as the vehicle moves along the right-of-way in an operating direction, wherein the device comprises a power-driven guide wheel rotatable about a horizontal axis extending transversely of the right-of-way and a plurality of abutment and entrainment elements mounted on the wheel and arranged to interdigitate between successive ones of the conveyed ties in an end region of the tie laying means adjacent the ballast, the abutment and entrainment elements consisting of arms radially extending from the guide wheel and carrying rollers at outer ends thereof.

5. The mobile apparatus of claim 4, wherein the paths of movement of the abutment and entrainment elements and of the ties conveyed by the tie laying means overlap at least over the range of two successive ties.

6. The mobile apparatus of claim 5, wherein the overlapping range of the movement paths extend over the entire length of the gliding conveyor and a portion of the roller conveyor corresponding to at least one tie width.

7. A mobile apparatus for laying a succession of spaced ties on track-supporting ballast along a right-of-way, which comprises a vehicle movable along the right-of-way, means arranged on the vehicle to receive the ties to be laid and to lower the received ties, means arranged on the vehicle to receive the lowered ties and to lay the ties on the ballast, the tie laying means including a roller conveyor, a gliding conveyor, and a device for spacedly laying the succession of the conveyed ties on the ballast as the vehicle moves along the right-of-way in an operating direction, wherein the device comprises two power-driven guide wheels respectively associated with an end region of the ties and rotatable about a horizontal axis extending transversely of the right-of-way and a plurality of abutment and entrainment elements mounted on each wheel and arranged to interdigitate between successive ones of the conveyed ties in an end region of the tie laying means adjacent the ballast, each of the conveyed ties having a leading face, and a guide stop associated with each guide wheel and engageable with the leading face of the successive ties.

8. The mobile apparatus of claim 7, wherein the paths of movement of the abutment and entrainment elements and of the ties conveyed by the tie laying means overlap at least over the range of two successive ties.

9. The mobile apparatus of claim 8, wherein the overlapping range of the movement paths extend over the entire length of the gliding conveyor and a portion of the roller conveyor corresponding to at least one tie width.

10. The mobile apparatus of claim 7, further comprising a lever carrying the guide stop, a horizontal axis extending transversely of the right-of-way supporting an end of the lever remote from the guide stop for pivoting, and a drive for pivoting the lever about the axis.

11. The mobile apparatus of claim 10, wherein the lever is of adjustable length.

12. A mobile apparatus for laying a succession of spaced ties on track-supporting ballast along a right-of-way, which comprises a vehicle movable along the right-of-way, means arranged on the vehicle to receive the ties to be laid and to lower the received ties, means arranged on the vehicle to receive the lowered ties and to lay the ties on the ballast, the tie laying means including a roller conveyor, a gliding conveyor, and a device for spacedly laying the succession of the conveyed ties on the ballast as the vehicle moves along the right-of-way in an operating direction, wherein the device comprises a power-driven guide wheel rotatable about a horizontal axis extending transversely of the right-of-way and a plurality of abutment and entrainment elements mounted on the wheel and arranged to interdigitate between successive ones of the conveyed ties in an end region of the tie laying means adjacent the ballast, and a tie aligning member associated with the guide wheel and arranged above the conveyed ties to cooperate with the successively conveyed ties for laterally aligning the ties, the aligning member tapering in the direction of the roller conveyor.

13. The mobile apparatus of claim 12, wherein the paths of movement of the abutment and entrainment elements and of the ties conveyed by the tie laying means overlap at least over the range of two successive ties.

14. The mobile apparatus of claim 13, wherein the overlapping range of the movement paths extend over the entire length of the gliding conveyor and a portion of the roller conveyor corresponding to at least one tie width.

* * * * *